US010286238B2

(12) United States Patent
Lalouz

(10) Patent No.: US 10,286,238 B2
(45) Date of Patent: May 14, 2019

(54) DRY CHEMICAL CLOSED RECOVERY SYSTEM FOR FIRE EXTINGUISHER SERVICE AND RELATED METHODS

(71) Applicant: Shlomo Lalouz, San Diego, CA (US)

(72) Inventor: Shlomo Lalouz, San Diego, CA (US)

( * ) Notice: Subject to any disclaimer, the term of this patent is extended or adjusted under 35 U.S.C. 154(b) by 217 days.

(21) Appl. No.: 15/067,775

(22) Filed: Mar. 11, 2016

(65) Prior Publication Data

US 2017/0259092 A1 Sep. 14, 2017

(51) Int. Cl.

| | |
|---|---|
| ***A62C 13/76*** | (2006.01) |
| ***A62C 13/00*** | (2006.01) |
| ***A62C 37/50*** | (2006.01) |

(52) U.S. Cl.

CPC ..... *A62C 13/76* (2013.01); *A62C 13/006* (2013.01); *A62C 37/50* (2013.01)

(58) Field of Classification Search

CPC ..... B65B 1/16; A62C 13/006; A62C 13/76
See application file for complete search history.

(56) References Cited

U.S. PATENT DOCUMENTS 2,806,781 A * 9/1957 Shepherd ..... C21C 1/02 266/216
3,875,980 A * 4/1975 Getz ..... B65B 1/16 141/104
3,942,561 A * 3/1976 Stoeffler ..... B65B 1/16 141/376
4,053,001 A * 10/1977 Healey ..... A62C 13/76 141/2

* cited by examiner

*Primary Examiner* — Timothy L Maust
*Assistant Examiner* — Timothy P. Kelly
(74) *Attorney, Agent, or Firm* — Strategy IP, a Professional Law Corporation

(57) ABSTRACT

A dry chemical closed recovery system for servicing fire extinguishers including first and second tanks, ball valves, and a pressure relief valve. The dry chemical closed recovery system accepts the high-pressure discharge from a dry chemical fire extinguisher and refills the fire extinguisher with dry chemical using low pressure. By manipulating the ball valves, the fire extinguisher can be refilled incrementally or all at once.

11 Claims, 7 Drawing Sheets

DRY CHEMICAL CLOSED RECOVERY SYSTEM FOR FIRE EXTINGUISHER SERVICE AND RELATED METHODS

TECHNICAL FIELD OF THE INVENTION

The present invention is related to a dry chemical closed recovery system for servicing fire extinguishers.

BACKGROUND

A fire extinguisher, or simply an extinguisher, is a portable device that is used to extinguish small fires, generally in emergency situations. Fire extinguishers are a first line of defense against fires in many homes, offices, and other commercial buildings and can be easily operated when the need arises. In many situations, several fire extinguishers may be conspicuously located inside and/or outside of buildings within ready access by persons in an emergency. Some facilities provide fire extinguisher training to persons working in the facility and ensure that everyone knows the location of nearby fire extinguishers. A typical extinguisher includes a pressurized vessel, usually cylindrical, that contains a dischargeable agent to extinguish the fire.

Many countries have requirements related to the location and servicing of fire extinguishers. For example, in the United States, fire extinguishers are required in all buildings, except homes, and are required to be serviced and inspected by a fire protection service company at a particular frequency. Generally, fire extinguishers are inspected annually, internal maintenance is performed every 3 to 6 years, and hydrostatic testing is done every 5 to 12 years, depending on the type of extinguisher.

For both internal maintenance and hydrostatic testing, fire extinguishers are emptied of the agent and depressurized. The extinguisher is disassembled, inspected, cleaned, lubricated, and if necessary, hydrostatic testing is performed. Any extinguisher found defective is replaced. Otherwise, the extinguisher is refilled with agent and pressurized. In the case of dry agent (or dry chemical) fire extinguishers, the agent can be re-used if in good condition. The refilled extinguisher is tagged as having maintenance service and put back into service.

One system used for dry chemical fire extinguisher maintenance utilizes a generally funnel-shaped hopper. A high-pressure hose is attached to a ball valve on the side of the hopper, near its top. The top of the hopper is fitted with a perforated lid having a filter and an air inlet is located near the bottom of the hopper. The bottom of the hopper tapers to a discharge port that is sized to attach to a tube, which in turn is attached to a manifold. The manifold is a rubber stopper sized to fit the top of the fire extinguisher and has two ports. One port is attached to the tube and the other port is attached to a vacuum source.

In operation, the discharge nozzle of a fire extinguisher is attached to the free end of the high-pressure hose. The ball valve is opened and the fire extinguisher is discharged into the hopper. The perforated lid allows the pressurized gas to escape while retaining the dry chemical in the hopper. Once all the chemical is discharged, the fire extinguisher is removed for inspection and/or testing.

To refill, the manifold is attached to the top of the fire extinguisher. A vacuum source is started and as air is pulled through the hopper, the dry chemical is pulled into the fire extinguisher. The air inlet may be opened intermittently to "fluff" the chemical as needed and to assist the flow of the chemical from the hopper. Once the fire extinguisher is filled with the proper amount of dry chemical, the vacuum is removed and the fire extinguisher is pressurized.

This system has several drawbacks, however. Vacuum sources for refilling and gas sources for fluffing the dry chemical are large, heavy, and noisy. This means that fire extinguishers requiring service must be brought to a maintenance station, such as a facility or mobile vehicle, e.g., a van or truck that houses the maintenance system. A great deal of time is spent by the technician moving fire extinguishers from their installed location to the maintenance station and back to the installed location. To save time, some technicians may bring several fire extinguishers to the maintenance station and empty them into the refill system. However, the potential for cross-contamination of dry chemicals is greatly increased by doing so.

Additionally, because the dry chemical is discharged into the hopper at high pressure and velocity, the dry chemical can be pushed through the filter in the perforated lid into the atmosphere and can cause it to clog. Furthermore, the open discharge port at the bottom of the hopper can allow the dry chemical to be blown through the tube and attached manifold into the atmosphere, where it may be breathed by the technician.

During refill, dry chemical may become clogged due to being pulled by vacuum. In addition, dry chemical may also be pulled into the vacuum source, causing fouling and/or failure of the vacuum.

SUMMARY

Embodiments of the present invention relate to a closed recovery system that includes a first tank having a first inlet and a first outlet. The closed recovery system also includes a second tank having a second inlet and a second outlet and the second inlet is coupled to the first outlet. A first ball valve coupled to the first inlet, and a second ball valve is between the first tank and the second tank and coupled to the first outlet and the second inlet. A third ball valve is coupled to the second outlet, and a pressure relief valve is coupled to a third outlet.

In other, more detailed embodiments of the invention, the closed recovery system further includes a filter manifold having a third inlet and a fourth outlet, the third inlet coupled to the third ball valve. In other, more detailed embodiments of the invention, the filter manifold is configured to couple to a fire extinguisher. In still other, more detailed embodiments of the invention, the pressure relief valve opens at a predetermined pressure. In yet other, more detailed embodiments of the invention, the predetermined pressure is approximately 5-10 psi.

In other, more detailed embodiments of the invention, the closed recovery system includes a high-pressure hose having a first end and a second end. The first end of the high-pressure hose is coupled to the first ball valve and the second end coupled a quick disconnect fitting. In still other, more detailed embodiments of the invention, at least a side of the first tank slopes toward the first outlet or a side of the second tank slopes toward the second outlet.

In still other, more detailed embodiments of the invention, the closed recovery system includes a mobile cart wherein at least one of the first tank and second tank is mounted to the mobile cart.

The present invention also relates to a method of using a closed recovery system, the method including steps of opening a first ball valve coupled to an inlet of a first tank, closing a second ball valve coupled to an outlet of a second tank, discharging dry chemical from a fire extinguisher through the inlet of the first tank until the fire extinguisher is fully discharged, and venting pressure in excess of approximately 5-10 psi through a relief valve coupled to the first tank. After discharging the fire extinguisher, closing the first ball valve. The method also includes steps of opening a third ball valve between an outlet of the first tank and an inlet of the second tank to allow the dry chemical to flow from the first tank to the second tank, closing the third ball valve, and opening the second ball valve to allow the dry chemical to flow through the outlet of the second tank. After the dry chemical in the second tank is discharged, closing the second ball valve, and reopening the third ball valve to allow dry chemical remaining in the first tank to flow to the second tank. The steps of opening and closing the second ball valve to empty the second tank and opening and closing the third ball valve to refill the second tank can be repeated until no dry chemical remains in the closed recovery system.

In other, more detailed embodiments of the invention, the step of opening the third ball valve between the outlet of the first tank and the inlet of the second tank to allow the dry chemical to flow from the first tank to the second tank is before the step of discharging the dry chemical from a fire extinguisher through the inlet of the first tank until the fire extinguisher is fully discharged. In other, more detailed embodiments of the invention, the dry chemical flows through the outlet of the second tank into a filter manifold and the filter manifold is coupled to a discharged fire extinguisher. In yet other, more detailed embodiments of the invention, the discharged fire extinguisher is the fire extinguisher that was discharged through the inlet of the first tank.

The present invention also relates to a method of using a closed recovery system, embodiments of the method including opening a first ball valve coupled to an inlet of a first tank, closing a second ball valve coupled to an outlet of a second tank, discharging dry chemical from a fire extinguisher through the inlet of the first tank until the fire extinguisher is fully discharged, venting pressure in excess of approximately 5-10 psi through a relief valve coupled to the first tank, after discharging the fire extinguisher, closing the first ball valve, and opening the second ball valve to allow the dry chemical to flow through the outlet of the second tank.

Other features of the invention should become apparent to those skilled in the art from the following description of the preferred embodiment(s) taken in conjunction with the accompanying drawings, which illustrate, by way of example, the principles of the invention, the invention not being limited to any particular preferred embodiment(s) disclosed.

BRIEF DESCRIPTION OF THE DRAWINGS

These and other features, aspects, and advantages of the present invention will become better understood with reference to the following description, appended claims, and accompanying drawings, where:

Unless otherwise indicated, the illustrations in the above figures are not necessarily drawn to scale.

DETAILED DESCRIPTION OF THE PREFERRED EMBODIMENTS

All of the features disclosed in the specification, including the claims, abstract, and drawings, and all of the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise. Thus, unless expressly stated otherwise, each feature disclosed is one example only of a generic series of equivalent or similar features.

Figure 1A:
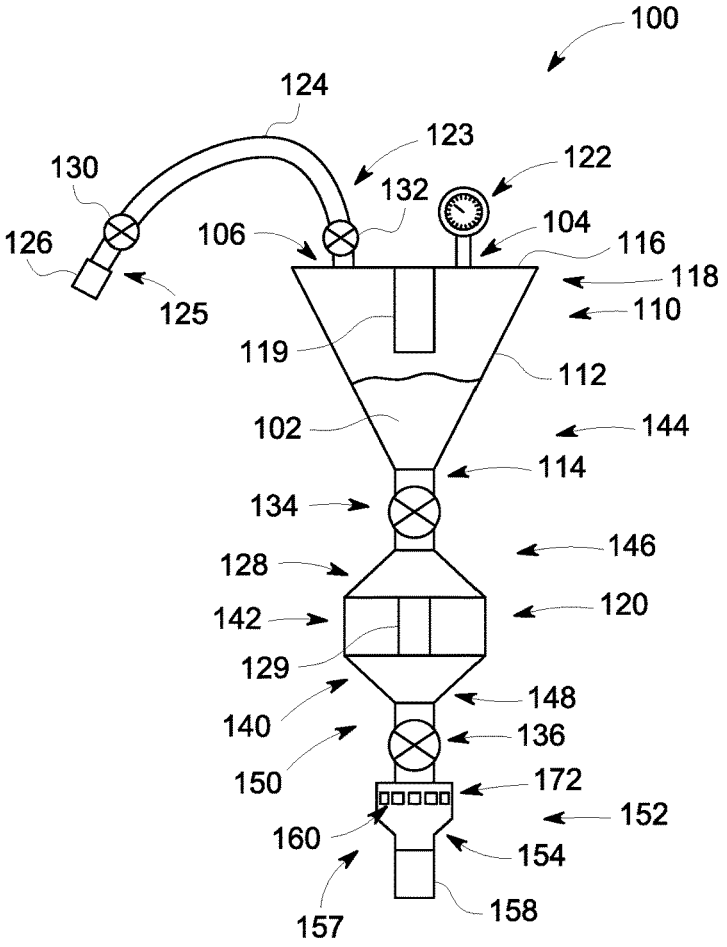
FIG. 1*a* is a front elevational view of a closed recovery system of a first embodiment according to the present invention.

A first embodiment of a closed recovery system 100 of the present invention is shown in FIG. 1*a*. The recovery system includes a first tank 110 and a second tank 120 coupled together.

First tank 110 is generally funnel-shaped and includes sloped sides 112. The sloped sides 112 allow gravity and pressure within first tank 110, as described below, to direct dry chemical 102 toward an opening 114 leading to second tank 120. First tank 110 also includes a lid 116, or cover, located along the top edge 118 of first tank 110. The lid 116 can be permanently attached to top edge 118, for example by welding the lid 116 to the top edge, or removably attached, for example by a releasable clamp (not shown). If lid 116 is removable, a gasket may be required to maintain pressure within first tank 110. In some embodiments, first tank 110 can further include an optional clear window 119 enabling a user of closed recovery system 100 to see into first tank 110.

The lid 116 has two openings. First opening 104 is coupled to a pressure gauge/pressure relief valve 122, and second opening 106 is coupled to the first end 123 of a high-pressure hose 124. The other end 125 of the high-pressure hose 124 is coupled to a first ball valve 130 that can close the end 125 of the high-pressure hose 124. Ball valve 130 is coupled to a quick disconnect fitting 126 that is configured to attach to a fire extinguisher nozzle and can be used to isolate the fire extinguisher from the high-pressure hose 124. A second ball valve 132 is coupled to the first end 123 of the high-pressure hose 124 near the lid 116 and can be used to isolate the high-pressure hose 124 from the first tank 110. A third ball valve 134 is coupled between bottom 144 of the first tank 110 and the top 146 of the second tank 120 and can be used to isolate the first tank 110 from the second tank 120.

The second tank 120 has sides 128 sloping outwardly from the top 146 and sides 140 sloping inwardly toward the bottom 148. Between the outwardly sloping sides 128 and the inwardly sloping sides 140, the second tank 120 may have generally vertical sides 142. Inwardly sloping sides 140 allow gravity and pressure within second tank 120, as described below, to direct dry chemical 102 toward an opening 150. A fourth ball valve 136 is located at the opening 150 at the bottom of the second tank 120 and can be used to isolate the second tank 120 from refill port 152. In some embodiments, second tank 120 can further include an optional clear window 129 enabling a user of closed recovery system 100 to see into second tank 120.

Figure 1B:
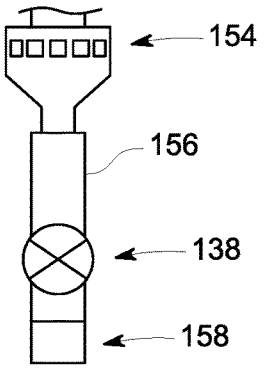
FIG. 1*b* is a partial front elevational view of an alternate embodiment of the refill port of FIG. 1*a*.

Refill port 152 can include a filter manifold 154. As seen in FIG. 1*a*, filter manifold 154 is coupled to the fourth ball valve 136. The filter manifold 154 includes vents 160 that are covered with filter material 172 to allow gas to escape, but not dry chemical 102 dust, when the dry chemical 102 is reintroduced into the fire extinguisher. The end 157 of the filter manifold 154 can be threaded to accept the threads of an empty fire extinguisher or the threads of an optional metal or plastic adapter 158 that threads onto an empty fire extinguisher. As shown in FIG. 1*b*, in alternative embodiments, the filter manifold 154 can be coupled between fourth ball valve 136 and a fill tube or hose 156. Optionally, a fifth ball valve 138 can be at the end of the fill tube or hose 156 opposite the filter manifold 154. An adapter 158 can be coupled to the end of the fill tube or hose 156 or fifth ball valve 138 (if present) and is used to couple an empty fire extinguisher to the closed recovery system 100. The adapter 158 may be threaded or may be pressure-fitted for coupling with the fire extinguisher.

Referring back to FIG. 1*a*, quick disconnect fitting 126 is a standard fitting used to quickly and easily connect hoses or tubing to another hose or to various vessels. Fittings 126 include two parts, one of which fits into the other in a male/female fashion to lock into place. Uncoupling is accomplished by lifting a collar, lever, or a small twisting motion. Useful fittings 126 are inert to the dry chemical 102 and are typically made of metal or plastic, for example, brass, chrome-plated brass, nickel plated brass, stainless steel, acetal, polypropylene, or acrylonitrile butadiene styrene (ABS).

High-pressure hose 124 is a standard hose known in the industry. Hoses can be made of rubber, plastic, or composites thereof, and can be layered or sheathed. Fibrous material or metal mesh can be encased within the hose 124 for additional strength. High-pressure hose 124 can be opaque, translucent, or transparent. Translucent and transparent hoses permit the user to see the flow of dry chemical 102 during discharge. The ability to see the flow of dry chemical 102 can be useful to determine when the fire extinguisher is fully discharged. The inner diameter of high-pressure hose 124 may vary, with typical diameters ranging from about ⅛ inches to ⅜ inches and may be ½ inches or more in diameter.

Pressure gauge/relief valve 122 is coupled to first tank 110. FIG. 1*a* shows the pressure gauge/relief valve coupled to the top of first tank 110 to reduce contamination with dry chemical 102, however, it may be coupled to closed recovery system 100 at any convenient location. Pressure gauge/relief valve 122 is made of metal, for example, brass, chrome-plated brass, nickel plated brass, stainless steel, or other metal that is inert to dry chemical 102. The relief valve portion is configured to allow a maximum of about 5 psi to about 10 psi of pressure to remain in first tank 110, or first tank 110 and second tank 120 if third ball valve 134 is open, and may be protected from dry chemical 102 by a filter. In some embodiments, the relief valve portion can be configured to allow a maximum of 25 psi to remain in the tank(s) so that neither first tank 110 nor second tank 120 is required to be hydrotested. Additionally, FIG. 1*a* shows the pressure gauge/relief valve 110 as a single element, however, a separate pressure gauge and relief valve can be used.

First tank 110 and second tank 120 can be made of the same material or can be different materials. Suitable materials include metals, such as stainless steel, carbon steel, iron, carbon fiber, plastic, and other materials that are not affected or corroded by the dry chemical 102. The thickness of materials is such that the tanks 110 and 120 are capable of holding about 5 psi to about 10 psi internal pressure, or as high as 25 psi.

The size of first tank 110 can vary, depending on the size of the fire extinguisher being serviced. In some embodiments, first tank 110 is sized to contain approximately 4× the volume of dry chemical 102 in a fire extinguisher. In other embodiments, first tank 110 is sized to contain approximately 20 pounds of dry chemical 102, and while in other embodiments, first tank 110 is sized to contain approximately 2-3 gallons of dry chemical 102. The size of second tank 120 can also vary. In some embodiments, second tank 120 is sized to contain ½ the volume of first tank 110. In other embodiments, second tank 120 is sized to contain approximately 10 pounds of dry chemical 102, and while in other embodiments, second tank 120 is sized to contain approximately 1-1.5 gallons of dry chemical 102. In yet other embodiments, second tank 120 is sized to hold less dry chemical 102 than one fire extinguisher. Thus, first tank 110 can be sized to hold dry chemical 102 from at least one fire extinguisher, and second tank 120 can be sized to hold dry chemical 102 from less than one fire extinguisher. In this manner, if a fire extinguisher is fully discharged into closed recovery system 100, second tank 120 may be filled with dry chemical 102 and first tank 110 may be at least partially filled. Additionally, since the pressure in first tank 110 and second tank 120 is limited by pressure gauge/relief valve 110 to less than about 25 psi, hydrostatic testing of the tanks is not needed.

First, second, third, fourth, and optional fifth ball valves 130, 132, 134, 136, 138 are standard ¼ turn ball valves that allow material to flow straight through. All the ball valves can be the same type of valve, or they may be different, for example, first and second ball valves 130, 132 can be rated for higher pressures than third, fourth, and optional fifth ball valves 134, 136, 138. In one embodiment, first and second ball valves 130, 132 can be rated at 195 psi and third, fourth, and optional fifth ball valves 134, 136, 138 can be rated at 10 psi. Ball valves 130, 132, 134, 136, 138 can be made of metal or plastic, for example, brass, chrome-plated brass, nickel plated brass, bronze, stainless steel, carbon steel, ceramics, acetal, polypropylene, acrylonitrile butadiene styrene (ABS), polyvinyl chloride (PVC), and chlorinated polyvinyl chloride (CPVC). Materials that form the ball valves 130, 132, 134, 136, 138 should be inert to the dry chemical 102.

Figure 2A:
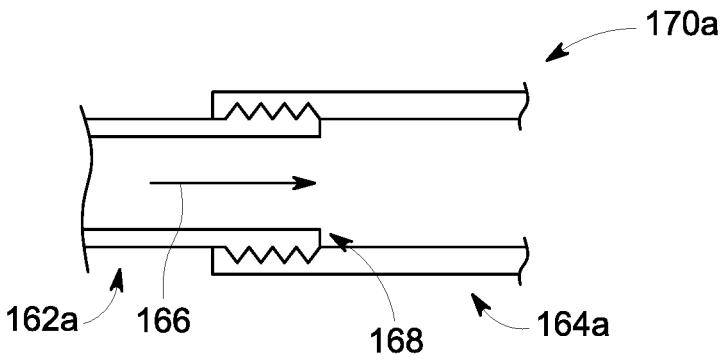
FIGS. 2*a* and 2*b* are cross-sectional views of connections in the closed recovery system of FIG. 1*a*.

Quick release fitting 126 and ball valves 130, 132, 134, 136, 138 are coupled to the closed recovery system 100 by threaded connections, compression fittings, hose barbs, or other type of connection, for example. An example connection 170*a* shown in FIG. 2*a* includes a male-threaded upstream portion 162*a* and a female-threaded downstream portion 164*a*. The arrow 166 indicates direction of flow. A ledge 168 is formed in the connection 170*a* due to the slightly different inner diameters of portions 162*a* and 164*a*.

Figure 2B:
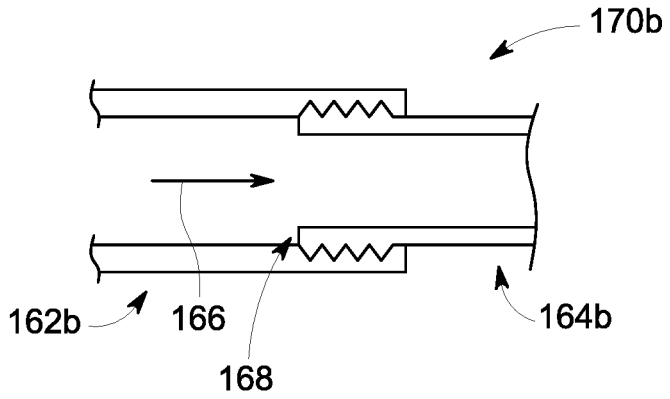

Gas and dry chemical 102 are able to pass by the ledge 168 without the dry chemical 102 becoming lodged. An alternative example connection 170*b* shown in FIG. 2*b* includes a female-threaded upstream portion 162*b* and a male-threaded downstream portion 164*b*. In this configuration, dry chemical 102 may remain on the ledge 168 after flow has stopped. Any dry chemical 102 remaining on the ledge 168 may be dislodged by the user, for example, by slightly shaking or jostling the connection or entire system 100, to avoid possible contamination with subsequent dry chemicals used. In one embodiment, connections include male upstream portions and female downstream portions.

Filter manifold 154 can be made of the same material as first tank 110 and second tank 120, such as metal or plastic, for example, stainless steel, carbon steel, and iron, carbon fiber, acetal, polypropylene, ABS, PVC, and CPVC. The thickness of the filter manifold 158 may be less than the thickness of first and second tanks 110, 120 since vents 160 allow reduction of pressure to ambient pressure. Filter material 172 is made of any material suitable of preventing dry chemical 102 from escaping, such as, tightly woven cloth or fabric, non-woven fibers, ceramic, or other material that allows only gas to escape. The same filter material can be used to protect pressure gauge/relief valve 110 as described previously. Filter material 172 can be easily changed to accommodate various types of dry chemical 102 or cleaned. Some filter materials 172 may be suitable for more than one type of dry chemical 102.

Figure 3:
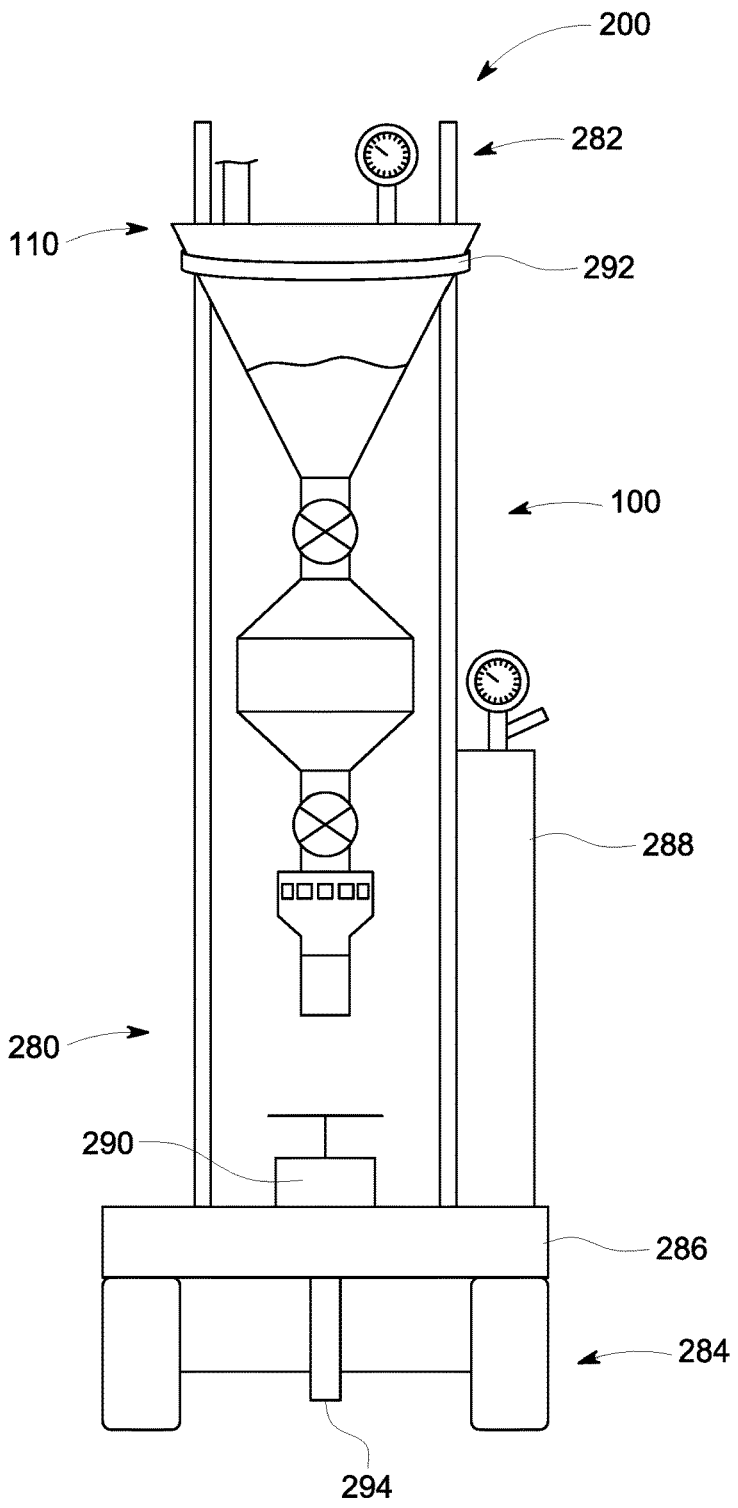
FIG. 3 is a front elevational view of a closed recovery system of a second embodiment according to the present invention.

Turning now to FIG. 3, a second embodiment of a closed recovery system 200 according to the present invention is shown. Closed recovery system 200 includes closed recovery system 100 mounted onto a mobile cart 280, such as a hand truck or wagon, for example.

Mobile cart 280 includes handles 282 that a user can grasp and use to maneuver the cart. The mobile cart 280 can have two or more wheels 284 which are in contact with the ground so that the mobile cart 280 can be easily moved from one location to another. If the mobile cart 280 has two wheels 284, the cart can also have a support 294 that holds the cart upright yet allows the cart to be tilted onto the wheels 284 when being moved.

Closed recovery system 100 can be coupled to the mobile cart 280 with a clamp or bracket 292. The clamp or bracket 292 can be a round ring with a diameter less that the diameter of the first tank 110 such that closed recovery system 100 is supported by the clamp or bracket 292. In some embodiments, closed recovery system 100 can be permanently or semi-permanently coupled to the clamp or bracket 292, for example, bolts can be used to couple the clamp or bracket to the first tank 110.

Closed recovery system 200 can also include a gas cylinder 288 and a weighing scale 290 that rest on a platform 286. The gas cylinder 288 can be used to recharge system 100 if there is insufficient pressure to cause dry chemical 102 to flow when refilling a fire extinguisher. The gas cylinder 288 is also used to pressurize a refilled fire extinguisher before placing it back into service. The weighing scale 290 is used to weigh the fire extinguisher to determine when sufficient dry chemical 102 has been added to a fire extinguisher being refilled.

Figure 9:
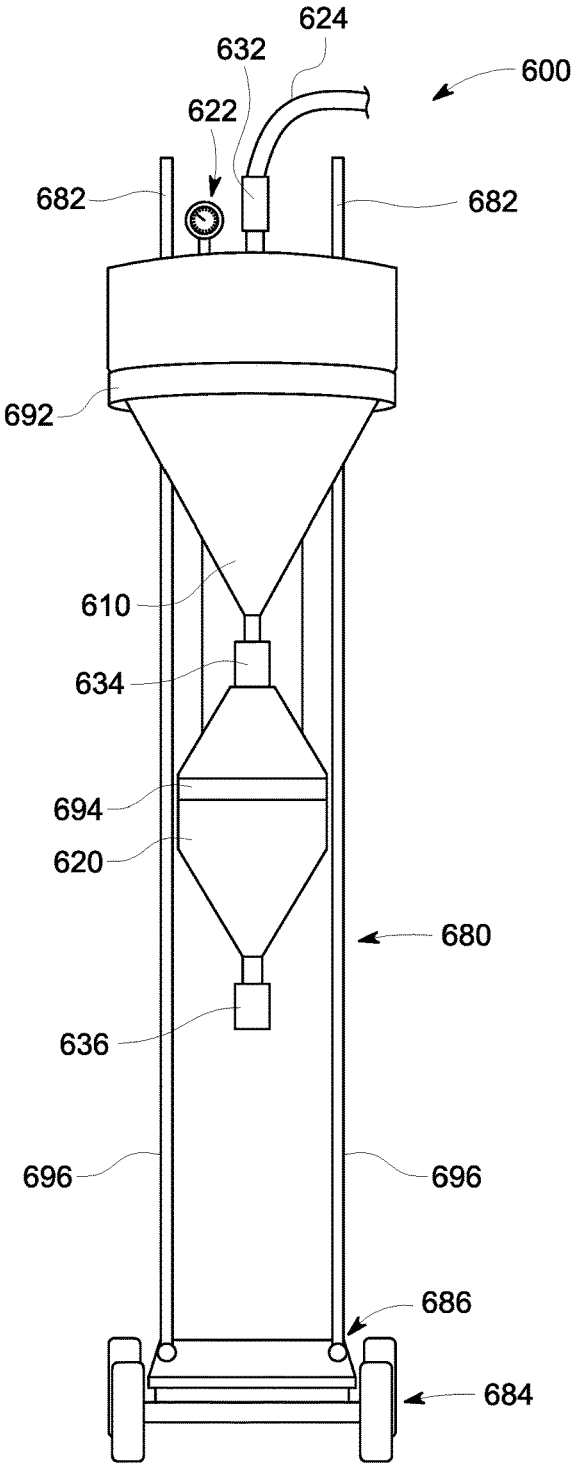
FIG. 9 is a front elevational view of a closed recovery system of a third embodiment according to the present invention.

Turning now to FIG. 9, a third embodiment of a closed recovery system 600 according to the present invention is shown. Closed recovery system 600 includes first tank 610 and second tank 620. First tank 610 and second tank 620 are similar in many respects to first tank 110 and second tank 120. High-pressure hose 624 is coupled to first tank 610 and can also be coupled to a fire extinguisher. Pressure gauge/relief valve 622 is attached to the top of first tank 610. Ball valve 632 is coupled between first tank 610 and high-pressure hose 624. Ball valve 634 is coupled between first tank 610 and second tank 620, and ball valve 636 is coupled to the bottom of second tank 620. Ball valves 632, 634, and 636 are similar to ball valves 132, 134, and 136, respectively.

Closed recovery system 600 also includes a hand truck 680. Hand truck 680 includes supports 696 to which clamps 692 and 694 are coupled. Clamps 692 and 694 can be generally circular and couple first tank 610 and second tank 620, respectively, to supports 696. The tanks 610, 620 may be held in place by gravity, or clamps 692, 694 may tighten onto tanks 610, 620. Alternatively, tanks 610, 620 may be permanently or removably coupled to clamps 692, 694 by nuts and bolts, screws, rivets, or welds, for example.

Hand truck 680 includes handles 682 at the top ends of supports 696. Handles 682 can be rubberized grips slipped over the ends of supports 696. Furthermore, supports 696 may be bent near the ends to form handles that are more ergonomical. Tray 686 is coupled to the bottom ends of supports 696. Tray 686 can be used for carrying a scale, a bottle of compressed gas, or other items the user may require for discharging and recharging a fire extinguisher. Hand truck 680 also includes at least a pair of wheels 684 for moving closed recovery system 600 easily from one location to another. Wheels 684 can be any size suitable for traversing the terrain from one location to another. Such terrain may include steps, uneven concrete, thick carpeting, etc., for example.

Supports 696 can be made of metals, metal alloys, plastics, and combinations thereof. Any material capable of supporting the weight being transported can be used. Supports 696 can be solid or hollow. Clamps 692, 694 can be made of metals, metal alloys, plastics, and combinations thereof. Any material capable of supporting the weight of the tanks 610, 620 and dry chemical 102 can be used. Additionally, clamps 692, 694 can be unitary, such as a ring, or can be made of several pieces. For example, clamps 692, 694 can be made of two pieces of material that are bolted together. By unbolting clamps 692, 694, tanks 610, 620, respectively, can be easily removed for cleaning or replacement.

Figure 4:
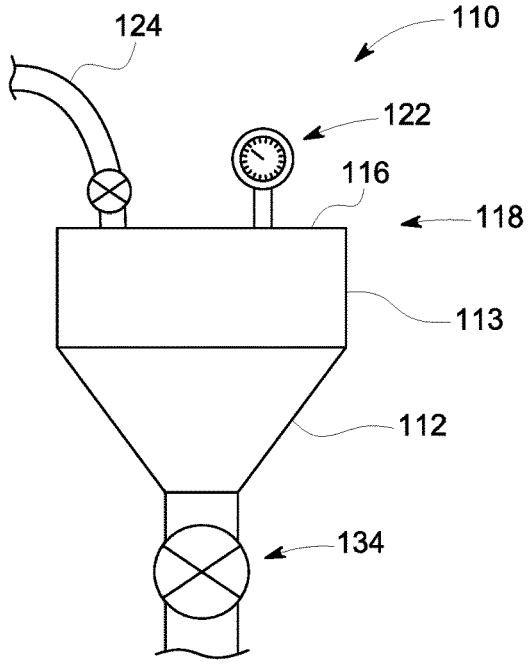
FIG. 4 is front elevational view of an alternative embodiment of the first tank according the present invention.

Turning now to FIG. 4, in some embodiments of closed recovery system 100, first tank 110 can include generally vertical sides 113 in addition to sloped sides 112. Vertical sides 113 can increase the volume of the first tank without increasing the diameter. In this manner, a single mobile cart 280 can be fitted with closed recovery systems 100 that can recharge larger fire extinguishers.

Figure 5:
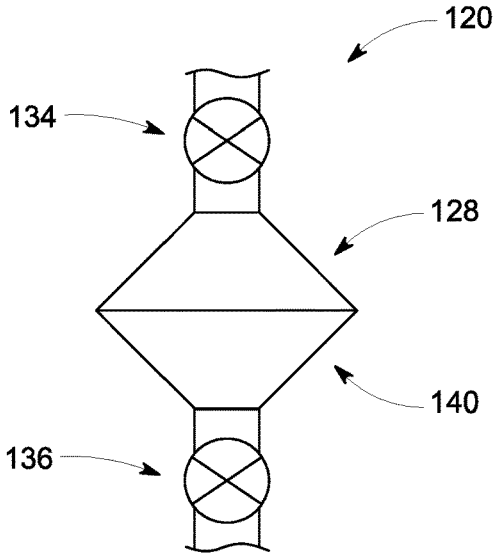
FIG. 5 is front elevational view of an alternative embodiment of the second tank according the present invention.

In some embodiments of closed recovery system 100, second tank 120 can include outwardly sloping sides 128 and inwardly sloping sides 140, as shown in FIG. 5.

Figure 6:
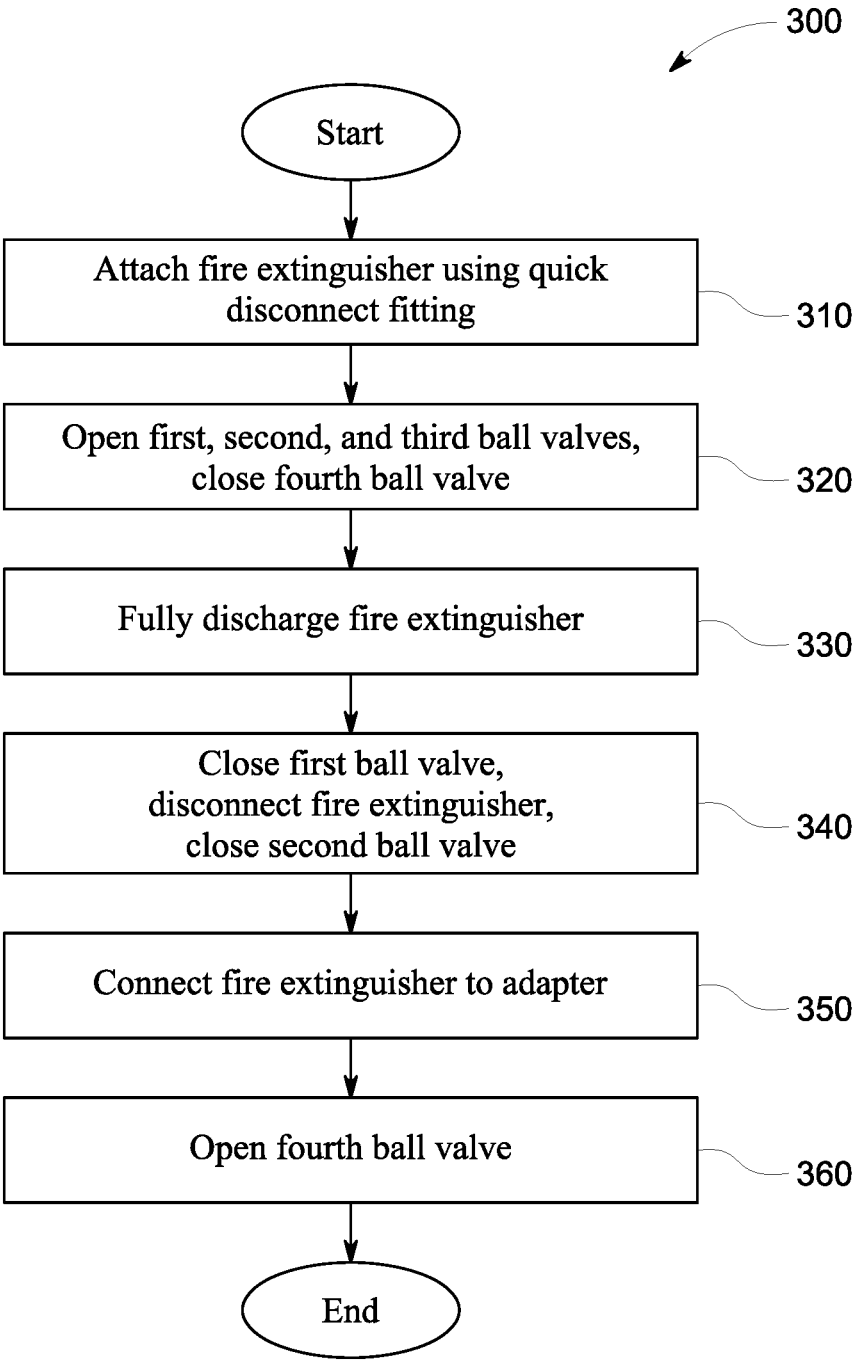
FIG. 6 is a flowchart schematically depicting one method of using the closed recovery system of FIG. 1*a* according to the present invention.

FIG. 6 is a flowchart of a method of using closed recovery system 100 according to the present invention, shown generally at 300. At step 310, a fire extinguisher is attached to quick disconnect fitting 126. An adapter may be fitted onto the fire extinguisher, if needed, for attachment. At step 320, first ball valve 130, second ball valve 132, and third ball valve 134 are opened to allow dry chemical 102 to flow into the closed recovery system 100, and fourth ball valve 136 is closed to prevent dry chemical 102 from escaping the closed recovery system 100.

At step 330, the fire extinguisher is fully discharged into the first tank 110 and the second tank 120 of the closed recovery system 100. Fire extinguishers are generally under high pressure, for example, 195 psi. Discharge of the fire extinguisher into the larger volume of the closed recovery system 100 reduces the pressure. The pressure is further reduced by venting gas through pressure gauge/relief valve 122 to approximately 5-10 psi.

After the fire extinguisher is fully discharged, at step 340, first ball valve 130 is closed and the fire extinguisher is disconnected from quick disconnect fitting 126. Second ball valve 132 may closed after ensuring all dry chemical 102 is emptied from the high-pressure hose 124, and the high-pressure hose removed. Alternatively, second ball valve 132 may remain open and high-pressure hose 124 remain attached. After removal, the fire extinguisher can be inspected and repaired, if needed. After inspection and repair, the fire extinguisher is ready to be recharged. At step 350, the fire extinguisher is connected to the filter manifold 154 at the bottom of the closed recovery system 100.

At step 360, fourth ball valve 136 is opened and pressure within the closed recovery system 100, along with gravity, forces the dry chemical 102 into the fire extinguisher. Pressure is vented through the filter material 172 covering the vents 160 on the filter manifold 154 to ambient pressure. The funnel shape of first tank 110 and second tank 120 help to guide the dry chemical 102 into the fire extinguisher. When all of the dry chemical 102 has been emptied from the closed recovery system 100, the fire extinguisher can be removed, weighed on scale 290 to assure the proper amount of dry chemical 102 is in the fire extinguisher, and the fire extinguisher re-pressurized using gas cylinder 288.

Figure 7:
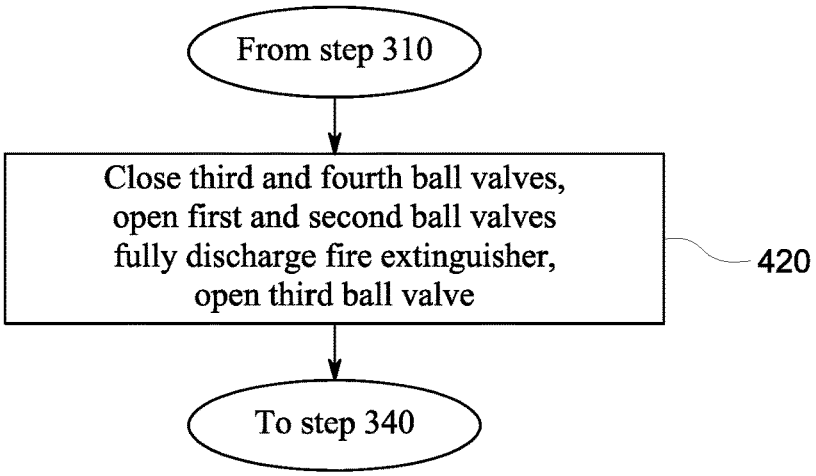
FIG. 7 is a partial flowchart schematically depicting a second method of using the closed recovery system of FIG. 1*a* according to the present invention.
Figure 8:
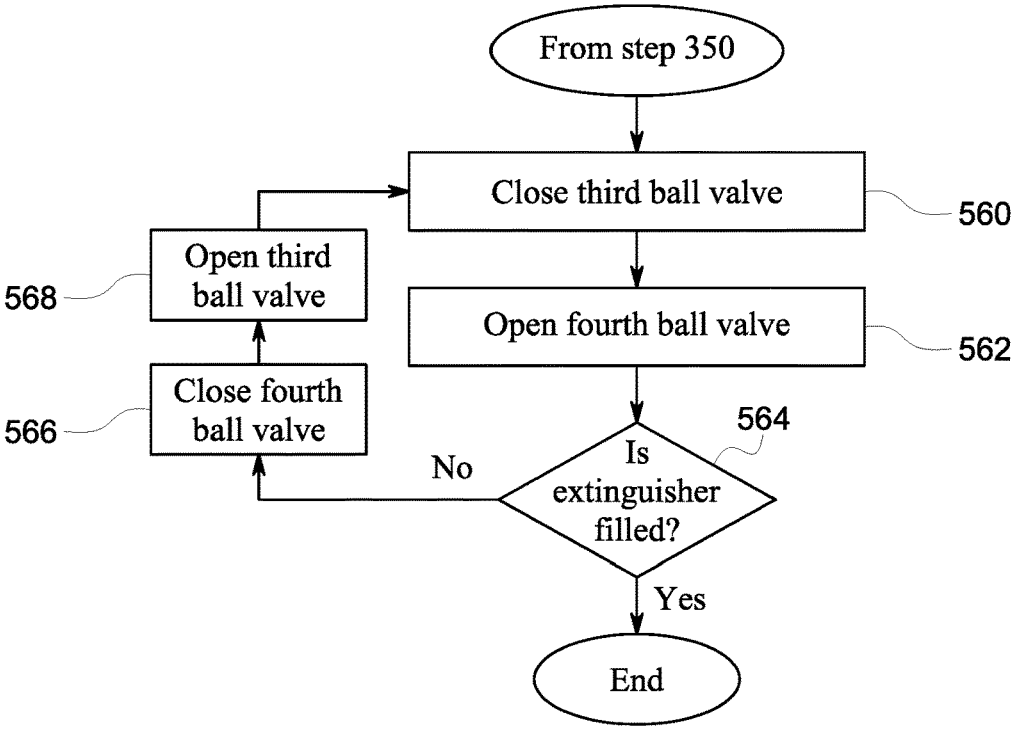
FIG. 8 is a partial flowchart schematically depicting a third method of using the closed recovery system of FIG. 1*a* according to the present invention.

In second method of using closed recovery system 100 according to the present invention, steps 320 and 330 are modified as shown in step 420 in FIG. 7. In step 420, third and fourth ball valves 134, 136 are closed, and first and second ball valves 130, 132 are opened. The fire extinguisher can then be fully discharged into the first tank 110 of the closed recovery system 100. The pressure is reduced to approximately 5-10 psi by venting pressurized gas through the pressure gauge/relief valve 122. After the fire extinguisher is fully discharged, third ball valve 134 is opened. The method continues at step 340 in FIG. 6. The second method makes use of a smaller volume of gas pressurized to 5-10 psi. Opening the third ball valve 134 while the first tank 110 is under lower pressure may help to prevent dry chemical 102 from caking in second tank 120.

In a third method of using closed recovery system 100 according to the present invention, step 360 is replaced with the steps shown in FIG. 7. At step 560, third ball valve 134 is closed. Fourth ball valve 136 is opened in step 562, allowing dry chemical 102 in second tank 120 to flow into the fire extinguisher. At step 564, the user determines if the fire extinguisher is filled. This can be done by closing the fourth ball valve 136 and weighing the fire extinguisher. Alternatively, the user can listen for gas escaping from the filter manifold 154 when the fourth ball valve 136 is opened. If the user determines the fire extinguisher is filled the method ends and the fire extinguisher is re-pressurized. If the fire extinguisher is not filled, the fourth valve 136 is closed in step 566. At step 568, the third valve 134 is opened, allowing additional dry chemical to move into the second tank 120. The method continues at step 560 by again closing the third ball valve 134. Third and fourth ball valves 134, 136 are alternately opened and closed in this manner to slowly fill the fire extinguisher with dry chemical 102. It should be noted that second tank 120 may be filled or only partially filled if third ball valve 134 is closed before second tank is full. By partially filling second tank 120, the fire extinguisher can be refilled slower than if second tank 120 were completely filled. By slowly filling the fire extinguisher according to the third method, dry chemical 102 can remain fluffed as it fills the fire extinguisher.

The foregoing detailed description of the present invention is provided for purposes of illustration, and it is not intended to be exhaustive or to limit the invention to the particular embodiments disclosed. The embodiments may provide different capabilities and benefits, depending on the configuration used to implement the key features of the invention. Accordingly, the scope of the invention is defined only by the following claims.

I claim:

1. A closed recovery system for servicing dry chemical fire extinguishers, the system comprising:
- a first tank including a first inlet and a first outlet;
- a second tank including a second inlet and a second outlet, the second inlet coupled to the first outlet;
- a first ball valve coupled to the first inlet;
- a second ball valve between the first tank and the second tank, coupled to the first outlet and the second inlet;
- a third ball valve coupled to the second outlet;
- a pressure relief valve coupled to a third outlet; and
- a filter manifold including a third inlet and a fourth outlet, the third inlet coupled to the third ball valve.

2. The closed recovery system of claim 1, wherein an adapter couples the filter manifold to a fire extinguisher.

3. The closed recovery system of claim 1, wherein the pressure relief valve opens when internal pressure of the closed recovery system exceeds a predetermined pressure.

4. The closed recovery system of claim 3, wherein the predetermined pressure is approximately 5-10 psi.

5. A closed recovery system for servicing dry chemical fire extinguishers, the system comprising:
- a first tank including a first inlet and a first outlet;
- a second tank including a second inlet and a second outlet, the second inlet coupled to the first outlet;
- a first ball valve coupled to the first inlet;
- a second ball valve between the first tank and the second tank, coupled to the first outlet and the second inlet;
- a third ball valve coupled to the second outlet;
- a pressure relief valve coupled to a third outlet; and
- a high-pressure hose including a first end and a second end, wherein the first end of the high-pressure hose is coupled to the first ball valve and the second end is coupled a quick disconnect fitting.

6. The closed recovery system of claim 1, wherein at least a side of the first tank slopes toward the first outlet or a side of the second tank slopes toward the second outlet.

7. The closed recovery system of claim 1 further comprising a mobile cart, wherein at least one of the first tank and second tank is mounted to the mobile cart.

8. The closed recovery system of claim 5, wherein the pressure relief valve opens when internal pressure of the closed recovery system exceeds a predetermined pressure.

9. The closed recovery system of claim 8, wherein the predetermined pressure is approximately 5-10 psi.

10. The closed recovery system of claim 5, wherein at least a side of the first tank slopes toward the first outlet or a side of the second tank slopes toward the second outlet.

11. The closed recovery system of claim 5 further comprising a mobile cart, wherein at least one of the first tank and second tank is mounted to the mobile cart.

* * * * *